US009477196B2

(12) United States Patent
Ohta et al.

(10) Patent No.: US 9,477,196 B2
(45) Date of Patent: Oct. 25, 2016

(54) IMAGE FORMING APPARATUS

(71) Applicants: Yoshihide Ohta, Kanagawa (JP); Tomoyuki Nishikawa, Saitama (JP)

(72) Inventors: Yoshihide Ohta, Kanagawa (JP); Tomoyuki Nishikawa, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/593,590

(22) Filed: Jan. 9, 2015

(65) Prior Publication Data

US 2015/0198922 A1 Jul. 16, 2015

(30) Foreign Application Priority Data

Jan. 14, 2014 (JP) ..... 2014-004123

(51) Int. Cl.
*G03G 15/00* (2006.01)

(52) U.S. Cl.
CPC ..... *G03G 15/6552* (2013.01)

(58) Field of Classification Search
CPC ..... G03G 15/6552; G03G 15/6555
See application file for complete search history.

(56) References Cited

U.S. PATENT DOCUMENTS 5,024,430 A * 6/1991 Seki et al. ..... 270/58.14
5,121,911 A * 6/1992 Yamazaki et al. ..... 270/58.13
5,951,004 A * 9/1999 Hadfy-Kovacs et al. .... 271/184
2001/0009625 A1* 7/2001 Tamehira ..... B41J 13/106 399/405
2002/0050675 A1* 5/2002 Saegusa ..... B65H 31/00 270/58.08
2004/0114958 A1* 6/2004 Katsuyama ..... H04N 1/00525 399/107
2006/0257183 A1 11/2006 Ehara et al.
2008/0170902 A1* 7/2008 Nakazawa ..... B41J 13/106 400/624
2008/0296826 A1* 12/2008 Saitsu ..... 270/58.02
2011/0169215 A1* 7/2011 Oh et al. ..... 271/227
2012/0245012 A1* 9/2012 Nozawa et al. ..... 493/405
2014/0112682 A1* 4/2014 Shimonaga ..... G03G 15/0879 399/107
2014/0167580 A1* 6/2014 Funayama ..... E05C 3/30 312/237

FOREIGN PATENT DOCUMENTS

JP 8-339102 12/1996
JP 2006-317704 11/2006
JP 2008-151885 7/2008
JP 2008-151886 7/2008
JP 2010-107612 5/2010

* cited by examiner

*Primary Examiner* — David Banh
(74) *Attorney, Agent, or Firm* — Harness, Dickey & Pierce, P.L.C.

(57) ABSTRACT

An image forming apparatus is provided, including an apparatus body; an image forming unit to form an image on a sheet member; and a sheet ejection container including a sheet ejection tray on which the sheet member ejected from the apparatus body is stacked. In the image forming apparatus, at least one side of the apparatus body is open and the sheet ejection container is disposed inside the apparatus body at the open side. The sheet ejection tray is configured to be movable between a first position in the sheet ejection container where the sheet member is ejected to the sheet member tray and a second position nearer to the open side than the first position.

14 Claims, 11 Drawing Sheets

IMAGE FORMING APPARATUS

CROSS-REFERENCE TO RELATED APPLICATIONS

The present application claims priority pursuant to 35 U.S.C. §119(a) from Japanese patent application number 2014-004123, filed on Jan. 14, 2014, the entire disclosure of which is hereby incorporated by reference herein.

BACKGROUND

1. Technical Field

Exemplary embodiments of the present invention relates to an image forming apparatus such as a printer, a facsimile machine, or a copier.

2. Background Art

Conventionally, image forming apparatuses including an inner sheet ejection unit disposed between an image reading unit to read an image of an original and an image forming unit to form an image on a sheet of paper, are known. The sheet of paper on which the image is formed is ejected onto the inner sheet ejection unit, which is enclosed by walls and is disposed inside the apparatus with one open side.

For example, conventional image forming apparatuses include an image forming unit disposed substantially in the middle of the apparatus body, and an image reading unit to read an image of the original above the image forming unit, with a predetermined space between the image reading unit and the image forming unit in which there is provided an inner sheet ejection unit having a sheet ejection tray onto which the sheet after image formation is ejected. This space-saving layout makes the apparatus more compact. In addition, the sheet ejected onto the sheet ejection tray of the inner sheet ejection unit can be removed from the open side manually.

SUMMARY

In one embodiment of the disclosure, there is provided an improved image forming apparatus that includes an apparatus body; an image forming unit to form an image on a sheet member; and a sheet ejection container including a sheet ejection tray on which the sheet member ejected from the apparatus body is stacked. At least one side of the apparatus body is open and the sheet ejection container is disposed inside the apparatus body at the open side. The sheet ejection tray is configured to be movable between a first position in the sheet ejection container, where the sheet member is ejected to the sheet member tray, and a second position nearer to the open side than the first position.

These and other objects, features, and advantages of the present invention will become apparent upon consideration of the following description of the preferred embodiments of the present invention when taken in conjunction with the accompanying drawings.

DETAILED DESCRIPTION

Preferred embodiments of an image forming apparatus employing electrophotography will be described. However, it is to be noted that the present invention is also applicable to an image forming apparatus employing an inkjet printing method.

Figure 1:
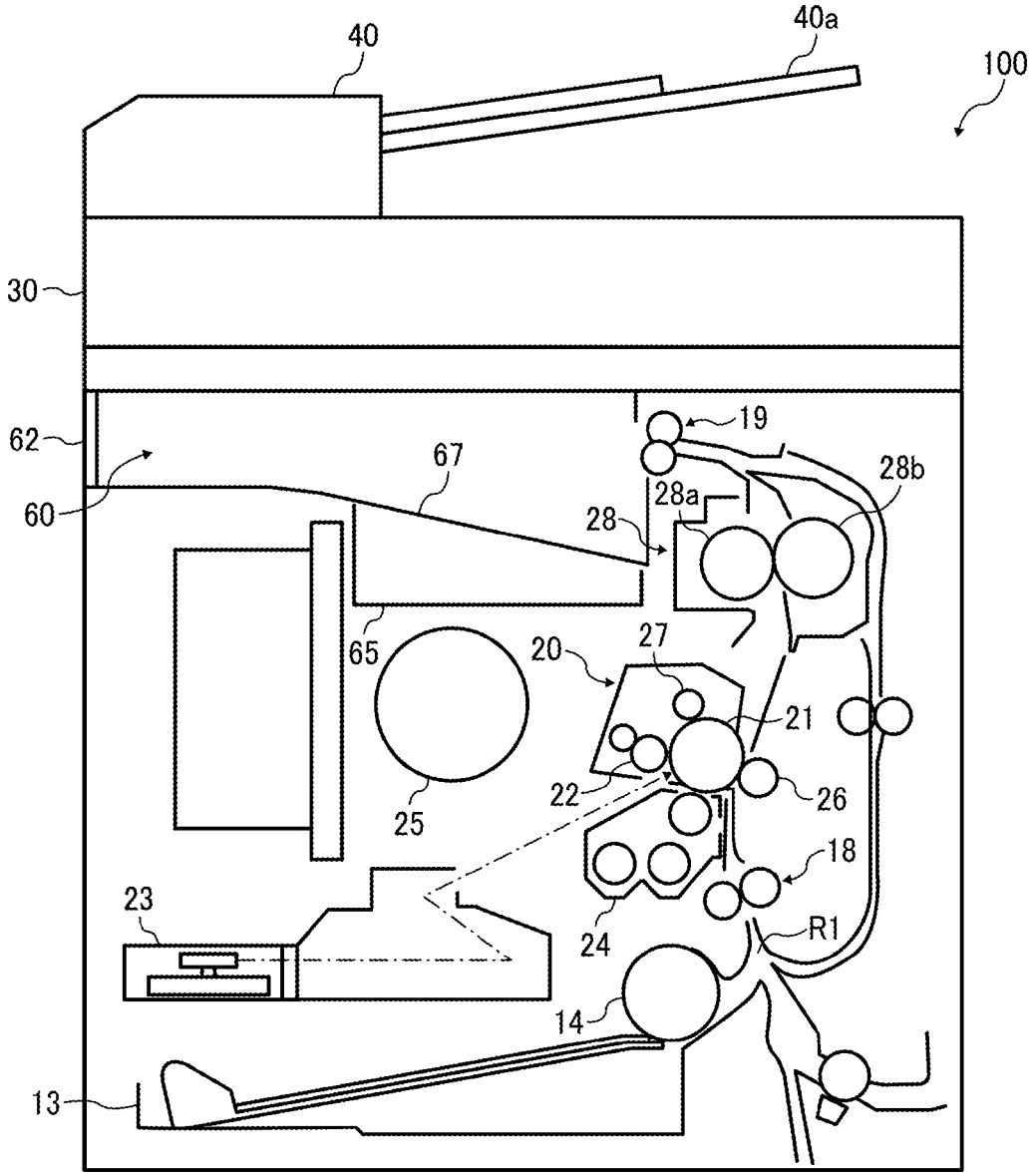
FIG. 1 illustrates a schematic configuration of an image forming apparatus according to an embodiment of the present invention.

FIG. 1 illustrates a schematic configuration of an image forming apparatus 100 according to an embodiment of the present invention. As illustrated in FIG. 1, the image forming apparatus 100 according to the present embodiment includes an image forming unit 20 in an interior of an apparatus body 10.

An automatic document feeder (ADF) 40 and a scanner 30 are disposed at an upper part of the apparatus body 10. A bundle of originals is placed on a tray 40*a* of the ADF 40. The ADF 40 separates and conveys each sheet one by one to the scanner 30. The scanner 30 reads an image on the original conveyed by the ADF 40.

The image forming unit 20 includes a photoconductor 21, a charger 22 including a charging roller, a writing device 23, a developing device 24, a toner supply device 25, a transfer roller 26, a cleaning device 27 including a cleaning roller, a discharger, and a fixing device 28. The fixing device 28 includes a heat roller 28*a* and a pressure roller 28*b*, both of which are pressed each other.

In addition, a paper tray 13 containing a plurality of sheets P is disposed in the bottom of the apparatus body 10. The paper tray 13 is provided with a sheet feed roller 14, and the like.

A sheet conveyance path R1 to convey the sheet P from the paper tray 13 to an upper, sheet ejection tray 67 is defined by surrounding components inside the apparatus body 10. A pair of registration rollers 18 is disposed in the sheet conveyance path R1 between the paper tray 13 and the photoconductor 21. A pair of sheet ejection rollers 19 is disposed at the end of the conveyance path R1.

In the image forming unit 20, first, a surface of the photoconductor 21 is uniformly charged by the charger 22 simultaneously with a rotation of the photoconductor 21. The optical writing device 23 exposes a surface of the photoconductor 21 with laser beams and optically writes an image thereon based on image data input from a personal computer or image data read by the scanner 30, and forms an electrostatic latent image on a surface of the photoconductor 21. Then, toner is adhered onto the electrostatic latent image by the developing device 24 and the latent image is rendered visible, so that a toner image is formed on the photoconductor 21.

On the other hand, the sheet feed roller 14 separates each sheet P one by one and conveys each sheet. Each sheet abuts a pair of registration rollers 18 and stops. The sheet P that stops by abutting the pair of registration rollers 18 is further conveyed to a transfer section where the photoconductor 21 and the transfer roller 26 are disposed opposite each other at a matched timing of the toner image formation by the image forming unit 20.

In the transfer section, a transfer electric field is formed between the photoconductor 21 and the transfer roller 26, and the toner image formed on the photoconductor 21 is transferred onto the sheet P by the transfer electric field. The heat roller 28*a* and the pressure roller 28*b* of the fixing device 28 apply heat and pressure to the sheet P on which the toner image has been transferred, so that the toner image thereon is fixed onto the sheet P with heat and pressure. The sheet P onto which the toner image is fixed is then ejected to the sheet ejection tray 67 by the pair of sheet ejection rollers 19.

A center alignment method is applied to the present embodiment, in which the sheet P is ejected onto the ejection tray 67 with a center of the sheet P in a direction perpendicular to the sheet conveyance direction set as a reference, regardless of the size of the sheet P used. On the other hand, the surface of the photoconductor 21 on which the residual toner after the toner image transfer remains is cleaned by the cleaning device 27, is electrically discharged by a discharger, and is readied for the next image formation.

Figure 2:
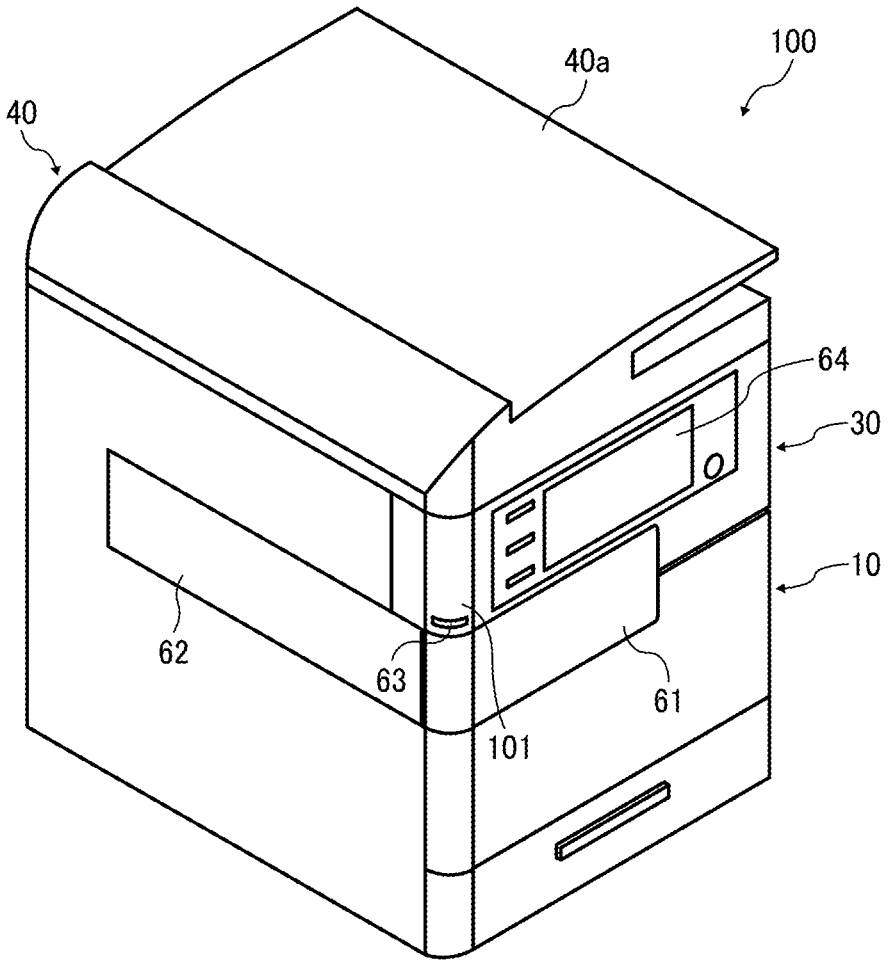
FIG. 2 illustrates a perspective view of the image forming apparatus according to an embodiment of the present invention.

FIG. 2 illustrates a perspective view of the image forming apparatus 100 according to an embodiment of the present invention.

An inner tray 60 is disposed in an internal area between the scanner 30 and the image forming unit 20 of the image forming apparatus 100. The inner tray 60 is enclosed top and bottom but includes at least one open side.

More specifically, in the present embodiment, a left wall of the inner tray 60 downstream in the sheet ejection direction when the sheet P is ejected to the sheet ejection tray 67 from an interior of the apparatus body and a front wall of the apparatus in the direction perpendicular to the sheet ejection direction are open.

Further, an openably closable front cover 61 and a left cover 62 are disposed to cover the inner tray 60. The front cover 61 and the left cover 62 are hinged and pivot about the hinge relative to the apparatus body 10.

A control panel 64 and a switch 63 are disposed on the side wall of the scanner 30 above the front cover 61. The switch 63 is used by a user to open or close the front cover 61 and the left cover 62. In addition, including controls on the operation of the front cover 61 and the left cover 62, a controller disposed inside the apparatus body 10 controls the whole operation of the image forming apparatus 100.

Herein, to make the apparatus more compact and to have higher printing capability, it is preferred that a height of the inner tray 60 be reduced, and that a shorter-side of the sheet be conveyed in parallel with the sheet conveyance direction, that is, a so-called long edge feed (LEF) method. As a result, the image forming apparatus 100 according to the present embodiment conveys the sheet P by the LEF method from the paper tray 13 to the inner tray 60 via the image forming unit 20.

However, because the image forming apparatus 100 should have greater depth in the distal-proximal direction (or front-back direction) in this case, a distance from the front of the apparatus to the sheet ejection center inside the inner tray 60 becomes longer than that in a case of employing a so-called short edge feed (SEF) method, in which a longer-side of the sheet is conveyed in parallel with the sheet conveyance direction. As a result, a length of the scanner 30 disposed above the inner tray 60 and covering the sheet P lengthens, so that the small-sized sheet P ejected and present inside the inner tray 60 is not so visible and cannot be removed from the inner tray 60 easily.

Note that the size of the surface of the sheet ejection tray 67 and of the platen on which the sheet P is placed is, when the sheet P is ejected onto the sheet ejection tray 67 by the LEF method, the size capable of accommodate A4-size sheet P and unable to accommodate A3-size sheet P.

More specifically, by ejecting the sheet P onto the sheet ejection tray 67, the width of the platen of the sheet ejection tray 67 in the sheet ejection direction from the pair of sheet ejection rollers 19 to the sheet ejection tray 67 is longer than a shorter-side of the A4-size sheet P and shorter than a shorter-side of the A3-size sheet P. On the other hand, the width of the platen of the sheet ejection tray 67 in the direction perpendicular to the sheet ejection direction is longer than a longer-side of the A3-size sheet P.

Figure 3:
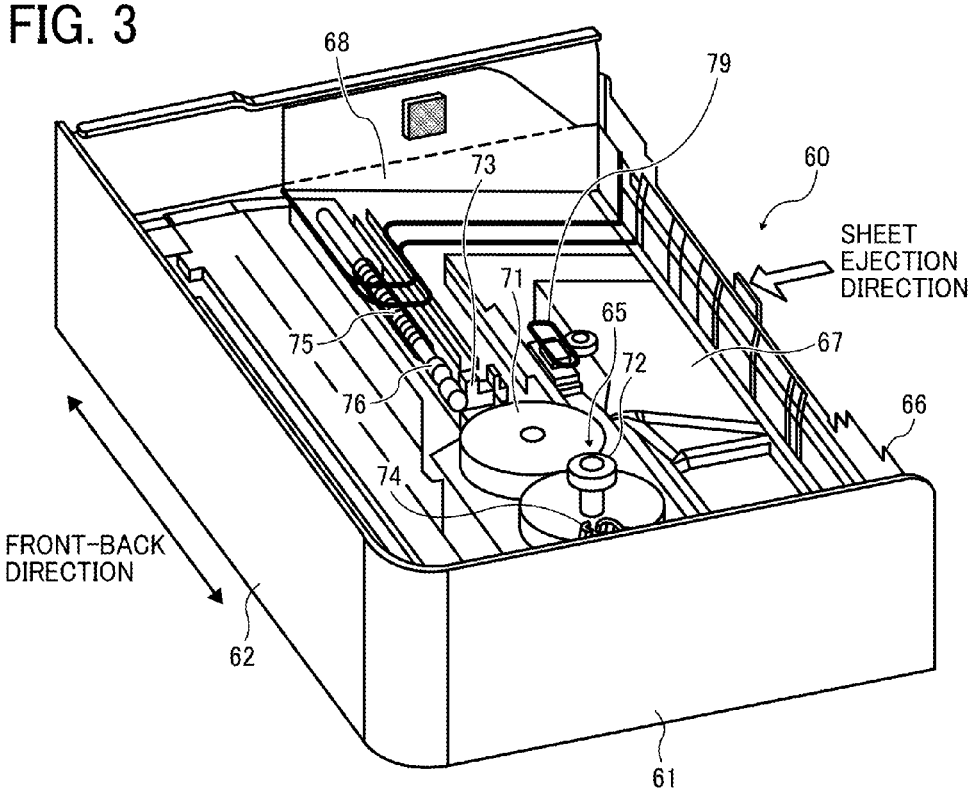
FIG. 3 is a perspective view of an inner tray of the apparatus.
Figure 4:
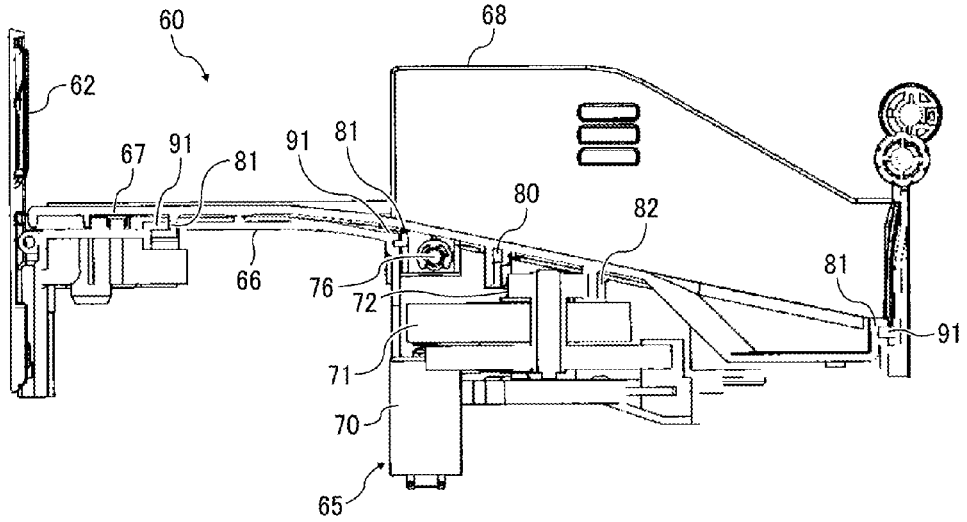
FIG. 4 is a cross-sectional view of the inner tray seen from the front of the apparatus.
Figure 5A:
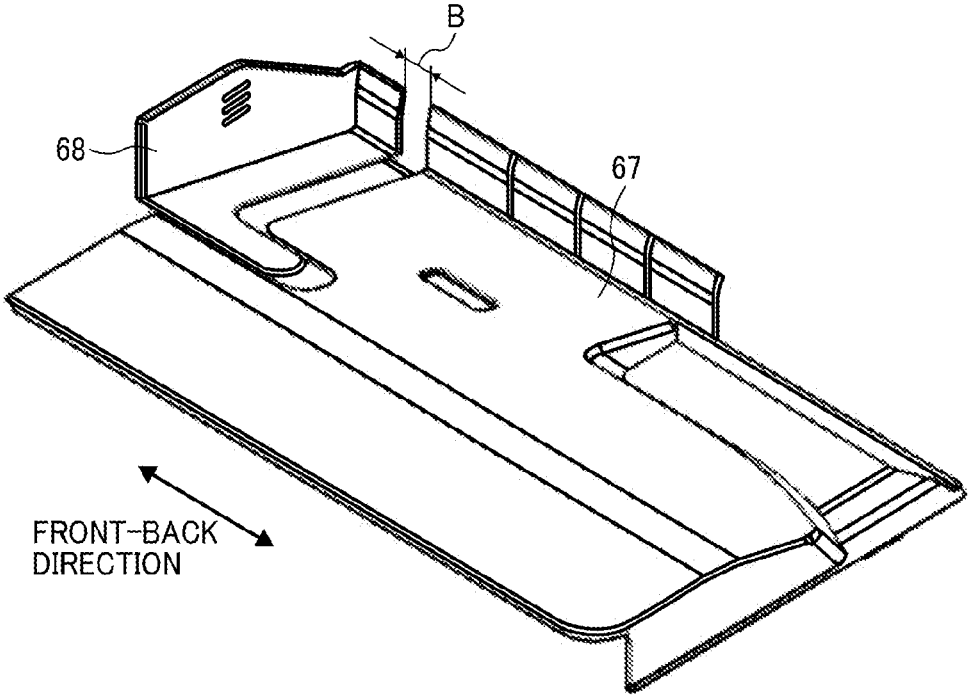
FIG. 5A is a perspective view of the sheet ejection tray seen from a platen on which the sheet is placed.

FIG. 3 is a perspective view of the inner tray 60. FIG. 4 is a cross-sectional view of the inner tray 60 seen from the front of the apparatus. FIG. 5A is a perspective view of the sheet ejection tray 67 seen from the platen on which the sheet P is placed.

A sheet ejection frame 66 of the inner tray 60 is secured to the apparatus body 10. In addition, below the sheet ejection frame 66 of the inner tray 60, a sheet ejection tray driver 65 including a drive motor 70, reduction gears, and a sheet ejection sensor 79 to detect the sheet P on the sheet ejection tray 67, are disposed.

The front cover 61 is hinged at the sheet ejection frame 66 along the bottom side thereof, and is constantly biased by a torsion spring toward a closing direction. In addition, similarly to the front cover 61, the left cover 62 is hinged at the sheet ejection frame 66 along the bottom side thereof, and a linking device, which will be described later, constantly biases the left cover 62 toward a direction to close the left cover 62.

The front cover 61 and the left cover 62 are closed relative to the apparatus body 10 to seal off a space inside the inner tray 60.

A guide 80 to prevent backlash in lateral directions of the apparatus and guide the sheet ejection tray 67 to move in the distal-proximal direction of the apparatus is disposed on a rear of the sheet ejection tray 67. A plurality of rails 81 to adjust a vertical position of the sheet ejection tray 67 and guide movement of the sheet ejection tray 67 in the distal-proximal direction of the apparatus, is disposed on the rear of the sheet ejection tray 67. The guide 80 and the rails 81 engage guide rails 91 disposed on the sheet ejection frame 66 and are held by the sheet ejection frame 66 to be movable in the distal-proximal direction of the apparatus alone.

A rack gear 82 is also disposed on the rear of the sheet ejection tray 67 and engages a tray drive gear 72 included in the reduction of the sheet ejection tray driver 65. Driving force of the drive motor 70 of the sheet ejection tray driver 65 is reduced by an idler gear 71 and the tray drive gear 72, both included in the reduction gears, and is transmitted to the rack gear 82, so that the sheet ejection tray 67 can be moved in the distal-proximal direction of the apparatus.

In addition, because an internal gear is used for the idler gear 71 that connects to the drive motor 70, a quiet, reliable drive transmission is provided. In addition, the drive transmission between the drive motor 70 and the idler gear 71 can be performed by a friction transmission using a V-belt, a flat belt, or a rubber roller.

Figure 5B:
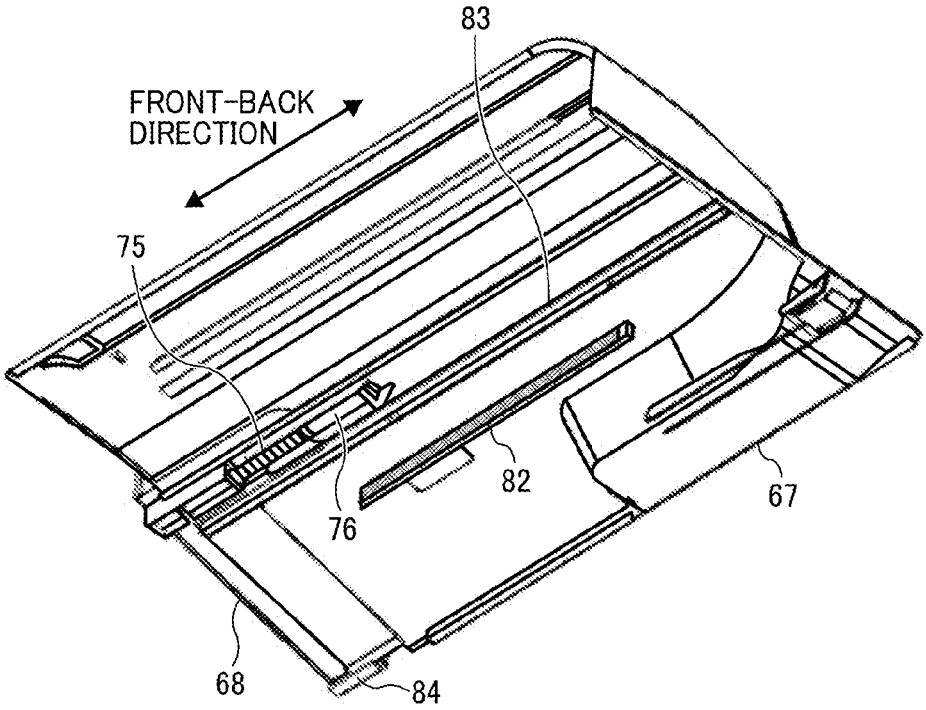
FIG. 5B is a perspective view of the sheet ejection tray seen from a rear of the tray.

FIG. 5B is a perspective view of the sheet ejection tray 67 seen from the rear of the tray. As illustrated in FIG. 5B, a guide shaft 76 is fixed at around one end of an end fence 68, passes through an engagement hole disposed on the sheet ejection tray 67 with a compression spring 75 sandwiched, and is stopped by an E-type retaining ring. A rail-shaped regulator 84 that holds and pinches the end of the sheet ejection tray 67 to regulate movement of the end fence 68 that pivots about the guide shaft 76 is disposed at the other end of the end fence 68.

When the sheet ejection tray 67 positions at a home position, a distance between the end fence 68 and the sheet ejection tray 67 is a distance A (see FIG. 7) in the distal-proximal direction of the apparatus. When the end fence 68 slides along the rail-shaped regulator 84, the end fence 68 can move to a position where the distance between the end fence 68 and the sheet ejection tray 67 becomes a distance B as illustrated in FIG. 5A in the distal-proximal direction of the apparatus.

Next, controlling the position of the sheet ejection tray 67 will be described.

Figure 6:
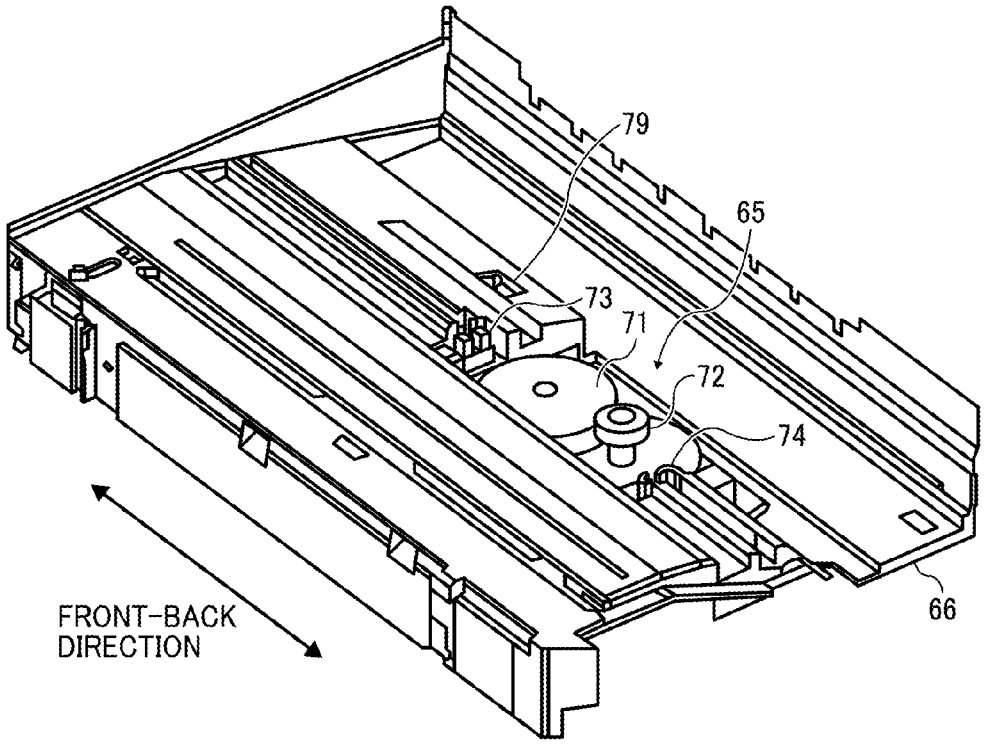
FIG. 6 is a perspective view of a sheet ejection frame.
Figure 7:
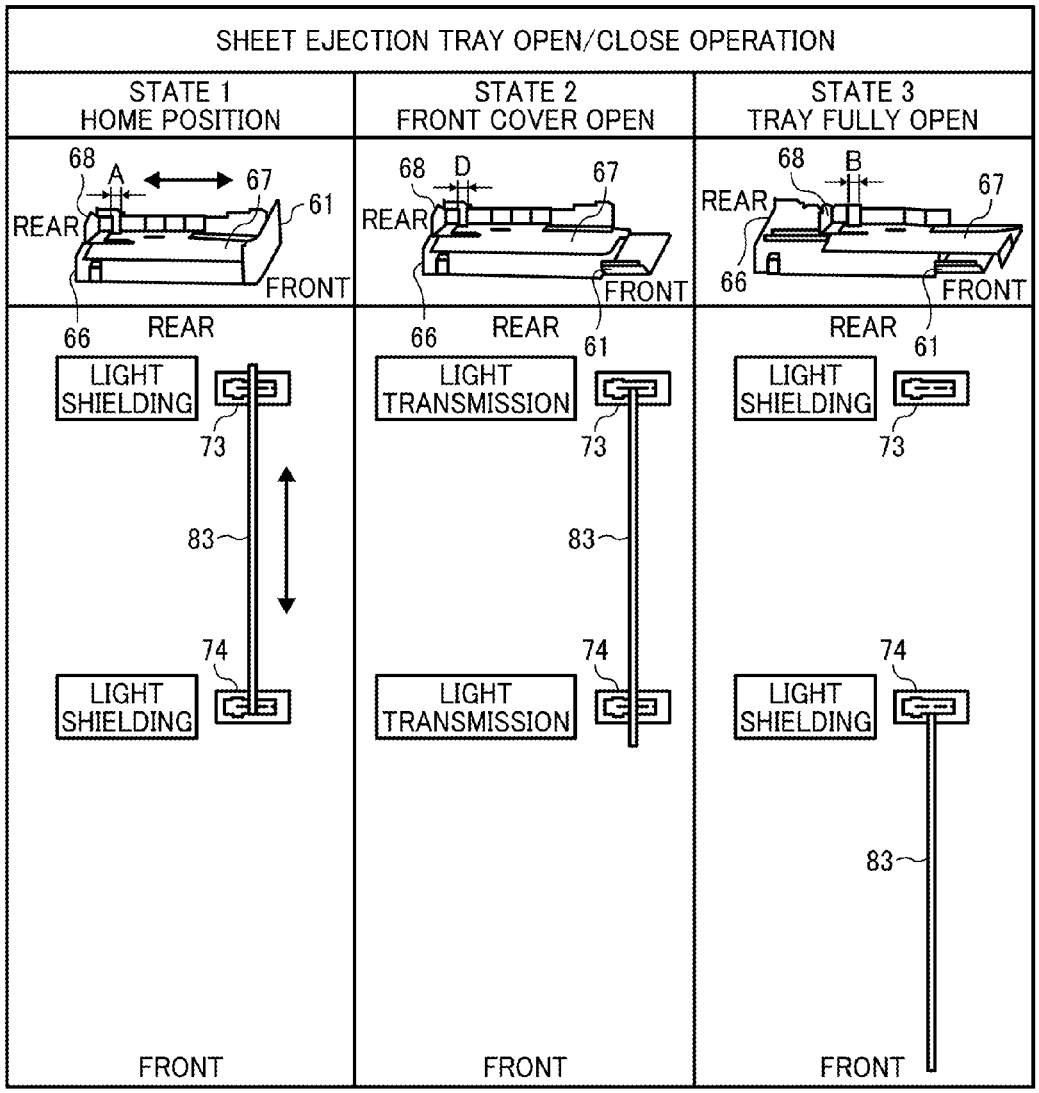
FIG. 7 shows states of the front cover and the sheet ejection tray in operation.

FIG. 6 is a perspective view of the sheet ejection frame 66. FIG. 7 shows states of the front cover 61 and the sheet ejection tray 67 in the operation. As illustrated in FIG. 6, a first position sensor 73 and a second position sensor 74 each to detect a position of the sheet ejection tray 67 are disposed near the sheet ejection tray driver 65 of the sheet ejection frame 66. Each of the first position sensor 73 and the second position sensor 74 is an optical sensor including a light-emitting part and a light receiving part, and each detects whether the light emitted from the light-emitting part to the light receiving part is blocked by a feeler 83 (shown in FIG. 5B) disposed on the rear surface of the sheet ejection tray 67 or received by the light receiving part without being blocked by the feeler 83.

As shown in Table 1, the position of the sheet ejection tray 67 is determined from a combination of the readings concerning the first position sensor 73 and the second position sensor 74, change in the state of the sheet ejection tray 67, and information on the previous movement, so that the position of the sheet ejection tray 67 can be controlled.

TABLE 1

| State | First position sensor 73 | Second position sensor 74 | Previous movement of tray |
|---|---|---|---|
| State 1 | Light blocked | Light blocked | Moved to state 1 in the previous time |
| State 2 | Light blocked | Light | Moved to state 2 or immediately after power on in the previous time |
| State 3 | Light transmitted | Light transmitted | No data |
| State 4 | Light blocked | Light transmitted | No data |
| State 5 | Light transmitted | Light blocked | No data |

A "change in state" means a change between each state including "state 1", "state 2", and "state 3" as illustrated in FIG. 7. Alternatively, the positional control of the sheet ejection tray 67 can be performed based on only a combination of the readings from the first position sensor 73 and the second position sensor 74.

It is to be noted that the image forming apparatus 100 according to the present embodiment employs two sensors to detect positions of the sheet ejection tray 67 to reduce costs. To determine a position of the sheet ejection tray 67 more accurately, one more sensor to detect a home position of the sheet ejection tray 67 can be added and the position of the sheet ejection tray 67 can be determined using readings from a total of three sensors.

Next, referring to FIG. 1, an operation of the front cover 61 and a movement of the sheet ejection tray 67 will be described. In the image forming apparatus 100 according to the present embodiment, when the sheet P is ejected onto the sheet ejection tray 67 via the LEF method, the front cover 61 is opened when the sheet P in the sheet ejection direction is shorter than the width of the sheet ejection tray 67 in the sheet ejection direction.

Figure 8A:
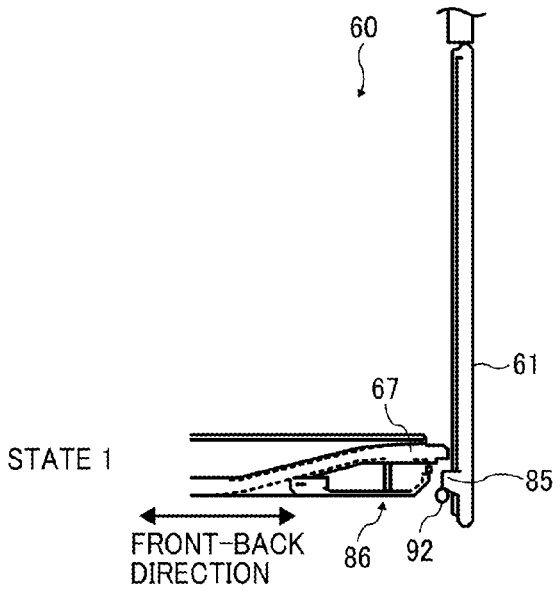
FIG. 8A shows positions of a front cover and a sheet ejection tray in a state 1 of FIG. 7.

FIG. 8A shows a position of the front cover 61 and the sheet ejection tray 67 in the state 1 of FIG. 7. In the state 1 in which the sheet ejection tray 67 positions at the home position, the sheet ejection tray 67 and the front cover 61 do not contact each other, and the front cover 61 is closed.

The end fence 68 contacts a wall in the distal side of the apparatus of the inner tray 60, and the distance between the sheet ejection tray 67 and the end fence 68 in the distal-proximal direction of the apparatus is the distance A that is shorter than the distance B.

Figure 8B:
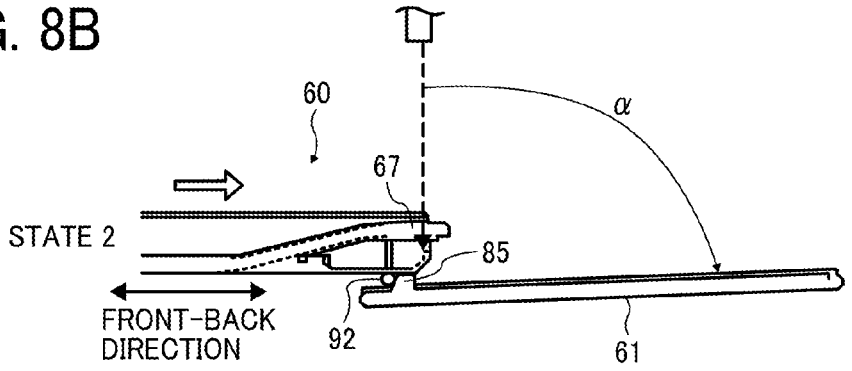
FIG. 8B shows positions of the same in a state 2 of FIG. 7.

FIG. 8B shows a position of the front cover 61 and the sheet ejection tray 67 in the state 2 of FIG. 7. Due to the driving force of the sheet ejection tray driver 65, the sheet ejection tray 67 is moved from the home position toward the front of the apparatus, the front end of the sheet ejection tray 67 abuts a position higher than a rotary shaft 92 of the front cover 61, so that the front cover 61 is pushed to open.

Then, when the sheet ejection tray 67 moves to the front of the apparatus by a distance D or more, a contact surface 86 disposed on the sheet ejection tray 67 parallel to a sliding direction and a cam-shaped part 85 of the front cover 61 contact. With this structure, as illustrated in FIG. 8B, an open angle of the front cover 61 becomes a maximum angle $\alpha$, and the cover arrives at the state 2 as illustrated in FIG. 7.

Herein, when the distances A, B, and D satisfy a relation D=/>B-A, the front cover 61 takes a maximum angle $\alpha$ and the end fence 68 keeps the most distal position in the inner tray 60 in the state 2. With this structure, in the state 2, the front cover 61 is open, the sheet P can be removed from the inner tray 60, and the sheet P can be ejected to the sheet ejection tray 67 continuously.

Accordingly, after a print job involving normal sheet sizes such as A4-size and B4-size is completed, the positions of the front cover 61 and the sheet ejection tray 67 are brought to the state 2, so that the sheet ejection tray 67 approaches an opening formed in the front of the apparatus than the home position in the state 1.

With this structure, visibility of the sheet P ejected onto the sheet ejection tray 67 can be improved and the sheet P can be removed more easily than a case in which the sheet ejection tray 67 positions at the home position at a more distal side than the position of the state 2.

During printing, the front cover 61 is closed to reduce noise and odor. When removing the sheet P, the front cover 61 is open and the sheet ejection tray 67 is positioned at the state 2, thereby improving the visibility of the sheet P and operability. In addition, without stopping the next print job, the sheet P can be ejected onto the sheet ejection tray 67. With this structure, the image forming apparatus 100 with better performance can be provided.

Figure 8C:
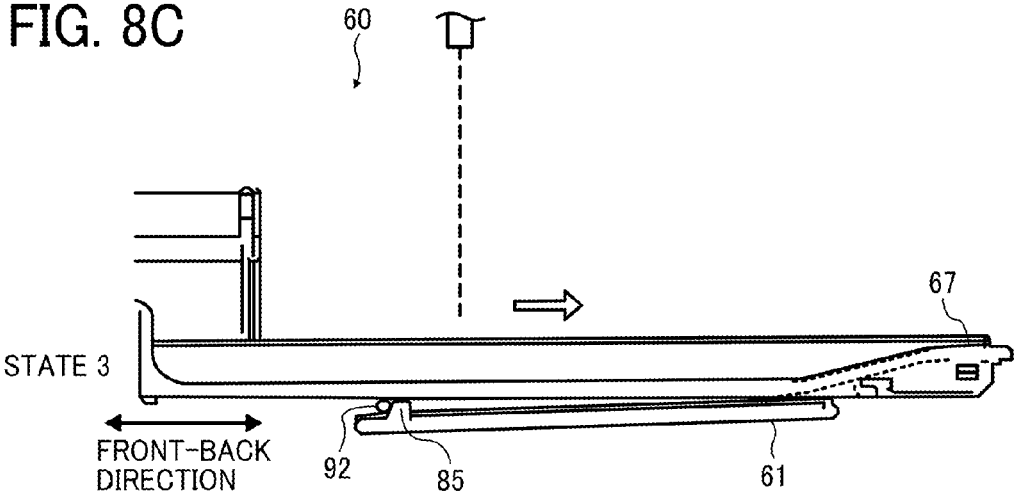
FIG. 8C shows positions of the same in a state 3 of FIG. 7.

FIG. 8C shows a position of the front cover 61 and the sheet ejection tray 67 in the state 3 of FIG. 7. When the sheet ejection tray 67 further advances from the position in the state 2, the sheet ejection tray 67 reaches a position where the tray is fully open as illustrated in FIG. 8C and the state 3 of FIG. 7.

When the sheet ejection tray 67 moves by more than the distance D from the home position, the open angle of the front cover 61 remains at the maximum angle α constantly regardless of moving amount of the sheet ejection tray 67 and the exposed amount of the sheet ejection tray 67 from the inner tray 60 alone changes. The sheet ejection tray 67 stops when the tray is fully open.

After completion of a print job involving a small-sized sheet such as a postcard, the front cover 61 and the sheet ejection tray 67 are brought to the state 3 from the state 1. With this structure, compared to a state in which the sheet ejection tray 67 positions at the home position in the distal end, the visibility of the sheet P on the sheet ejection tray 67 can be improved and the sheet P can be removed easily in the state 3 where most part of the sheet ejection tray 67 is exposed outside the opening disposed on the front wall of the apparatus.

In the printing, the front cover 61 is closed to reduce noise and odor. When removing the sheet P, the front cover 61 is open and the sheet ejection tray 67 is positioned at the state 3, thereby improving the visibility of the small-sized sheet P and operability.

When removing the small-sized sheet from the sheet ejection tray 67, even though the sheet P is pushed to the depths of the inner tray 60, the end fence 68 stops the sheet at a certain position around the distal-proximal direction center of the apparatus, and thus, the sheet can be removed from the inner tray 60. On the other hand, when the front cover 61 and the sheet ejection tray 67 are moved from the state 3 to the state 1 of FIG. 7, the sheet ejection tray driver 65 allows the sheet ejection tray 67 to move from the tray full-open position to the home position.

When the sheet ejection tray 67 reaches the home position, the front cover 61 is rotated to a closing direction manually relative to the apparatus body 10 and the front cover 61 is closed. Alternatively, the front cover 61 can be configured to automatically rotate to a closing direction relative to the apparatus body 10.

Figure 9:
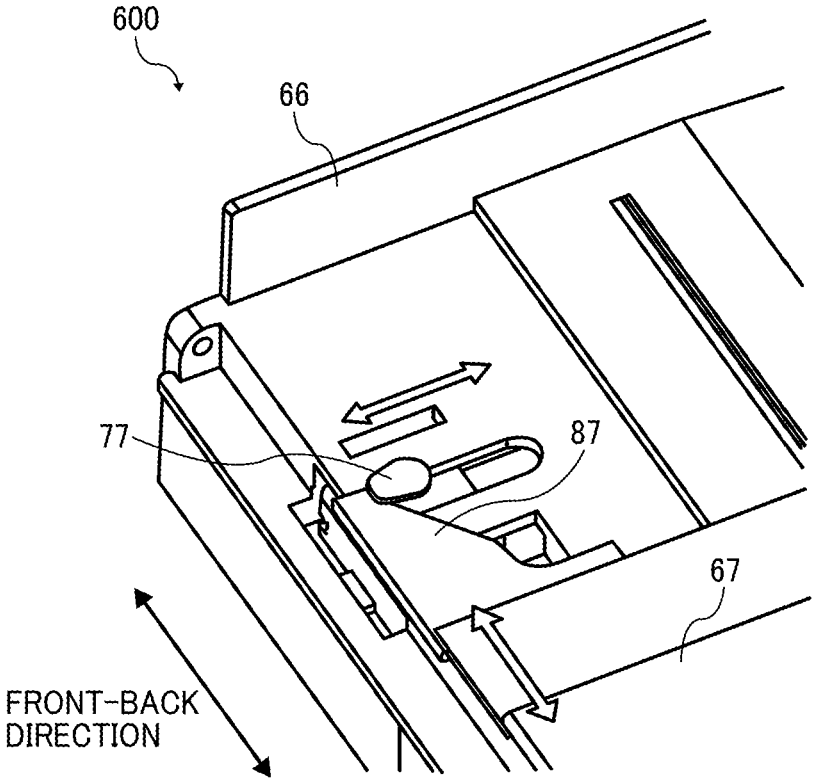
FIG. 9 is a schematic view of an opening/closing assembly to open and close a left cover.
Figure 10:
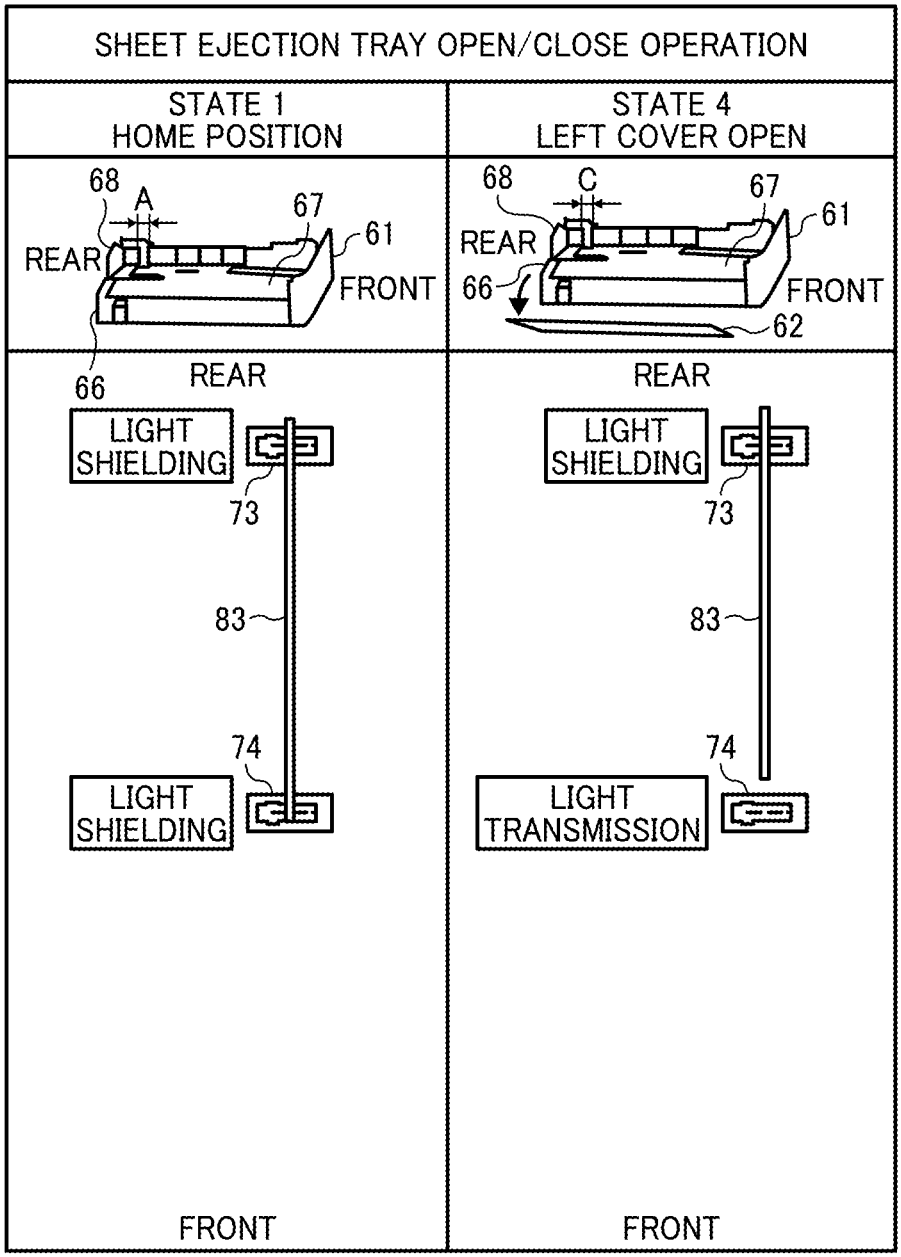
FIG. 10 shows states of the left cover and the sheet ejection tray in the operation.

FIG. 9 shows an opening/closing assembly 600 to open and close the left cover 62. FIG. 10 shows states of the left cover 62 and the sheet ejection tray 67 in the operation. As shown in Table 1, the position of the sheet ejection tray 67 is determined from a combination of the readings from the first position sensor 73 and the second position sensor 74, change in the state of the sheet ejection tray 67, and information on the previous movement, so that the position of the sheet ejection tray 67 can be controlled.

Figure 11A:
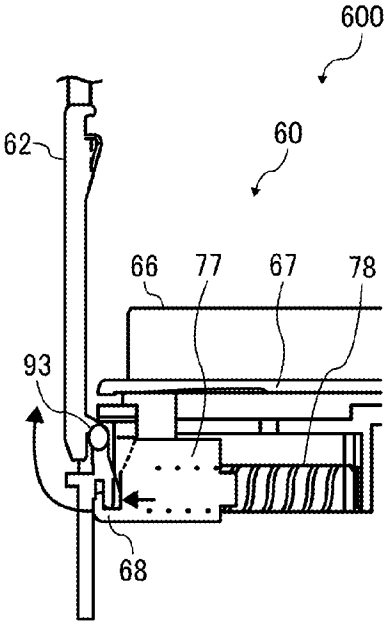
FIG. 11A shows positions of the left cover and the sheet ejection tray in a state 1 of FIG. 10.

FIG. 11A shows positions of the left cover 62 and the sheet ejection tray 67 in the state 1 of FIG. 10. In the state 1 in which the sheet ejection tray 67 positions at the home position, the left cover 62 includes a hook portion 88 disposed below the rotary shaft 93, a left cover pressure spring 78 biases a hook portion 88 via a biasing member 77. Thus, the left cover 62 maintains a closed state.

Figure 11B:
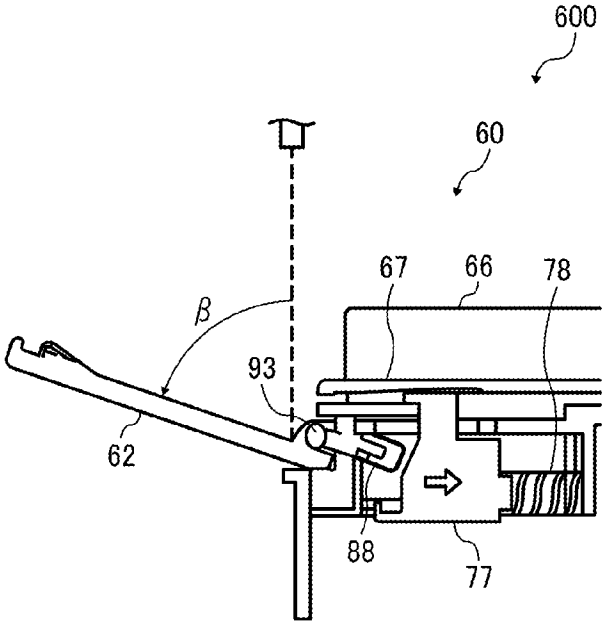
FIG. 11B shows a state in which the sheet ejection tray moves from a home position to the rear of the apparatus.

When the sheet ejection tray 67 moves to the rear of the apparatus from the home position by the sheet ejection tray driver 65, the biasing member 77 moves right by a left cam-shaped portion 87 disposed on the sheet ejection tray 67 as illustrated in FIG. 11B. The left cover 62 is rotated about the rotary axis 93 to an opening direction relative to the apparatus body 10 until the hook portion 88 of the left cover 62 is disengaged from the biasing member 77.

With this structure, the left cover 62 is applied with an initial speed toward the opening direction, gravitational center of the left cover 62 positions outside the apparatus than the rotary axis 93, so that the left cover 62 automatically opens to a maximum open angle β and is held with its own weight, and the cover arrives at a state 4 of FIG. 10.

Figure 11C:
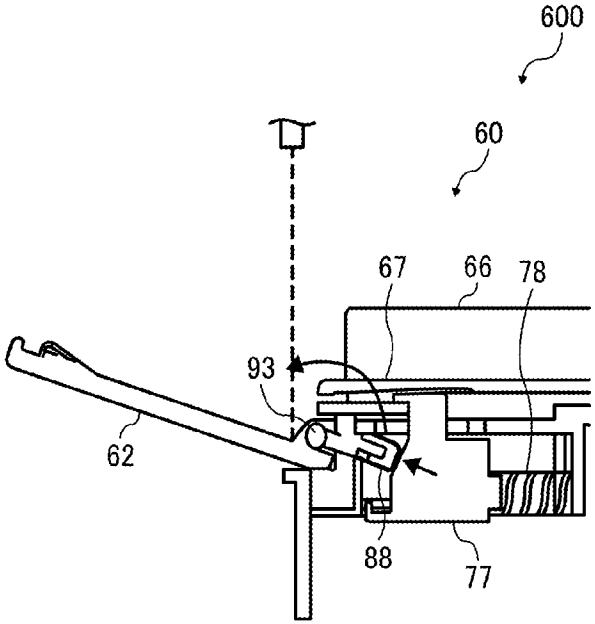
FIG. 11C shows a state in which the sheet ejection tray moves from the rear to the front of the apparatus.

When the sheet ejection tray 67 moves to the front of the apparatus from the state 4 of FIG. 10 drawn by the sheet ejection tray driver 65, the biasing member 77 contacts a position of the hook portion 88 to bias the left cover 62 to an opening direction as illustrated in FIG. 11C. Thus, the left cover 62 maintains an open state.

The opening of the left cover 62 allows the sheet ejection tray driver 65 to open the left cover 62 automatically and bring the state 1 to the state 4 of FIG. 10 upon detecting that a print job using a long-size sheet P such as an A3-size sheet that cannot be accommodated in the sheet ejection tray 67.

This is because when the A3-size sheet is ejected to the sheet ejection tray 67 by the SEF method, the length of the sheet P in the sheet ejection direction becomes longer than the width of the sheet ejection tray 67 in the sheet ejection direction to the sheet ejection tray 67, and accordingly, in the state in which the left cover 62 is closed, the A3-side sheet P cannot be ejected to the sheet ejection tray 67.

In addition, when the left cover 62 is open, because the left cover 62 functions as an extension tray, even the A3-size sheet P can be stacked on the sheet ejection tray 67 and the left cover 62. With this structure, a relatively quiet, low-odor image forming apparatus 100 is provided when the left cover 62 is closed during printing, and a long-size sheet such as the A3-size sheet P can be stacked on the sheet ejection tray in a compact body.

According to an embodiment of the present invention, the front cover 61 and the left cover 62 can be open or closed by a driving force from the drive motor 70 as a single drive source disposed on the sheet ejection tray driver 65. With this structure, an apparatus can be provided that is less expensive than a case in which a plurality of drive motors is provided for each of the front cover 61 and the left cover 62.

Figure 12A:
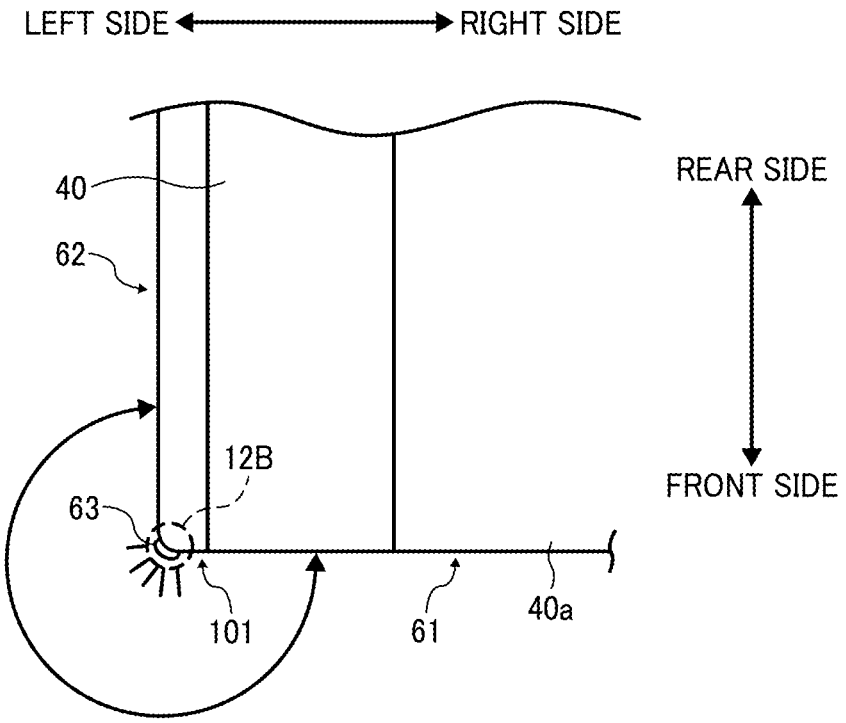
FIGS. 12A and 12B illustrate a switch for opening and closing the covers.
Figure 12B:
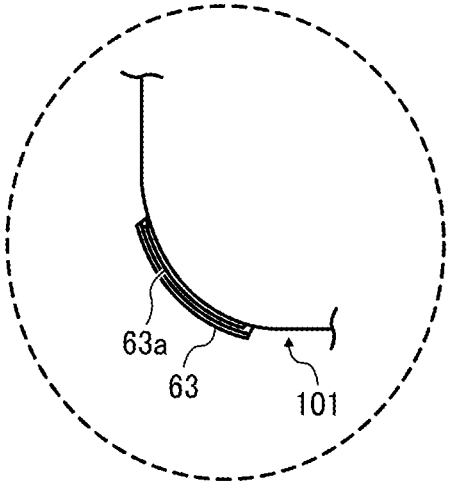

Referring now to FIGS. 12A and 12B, the switch 63 for opening and closing the covers will be described in greater detail.

In the image forming apparatus 100 according to the present embodiment, the operation of the sheet ejection tray 67 and the front cover 61 is set to be operated in conjunction with the print job, and further, the sheet ejection tray 67 and the front cover 61 can be open or closed by pushing the switch 63.

With this structure, the sheet P ejected to the inner tray 60 can be removed without any concern whether the printing is being performed or not, so that user-friendliness is improved.

In the present embodiment, the switch 63 is disposed on the left-front exterior wall 101 adjacent to the front cover 61 that positions at the front of the apparatus, and is molded with transmission resins. In addition, an LED 63*a*, a light-emitting diode, is disposed in an interior of the switch 63. Then, the LED 63*a* illuminates the switch 63 to thus prompt pressing of the switch 63.

In addition, as illustrated in FIG. 12, the switch 63 is disposed to cross a boundary of the front and the left side of the apparatus. As a result, the switch 63 is visible through a range extending over 270 degrees excluding the right-rear of the apparatus. As a result, design flexibility of the image forming apparatus 100 can be drastically improved.

In the present embodiment, the sheet ejection tray 67 and the end fence 68 are movably allocated; however, by making the end fence 68 alone movable, the sheet P can be pulled toward the front of the apparatus.

The aforementioned embodiments are examples and specific effects can be obtained for each of the following aspects of A to H:

<Aspect A>

An image forming apparatus 100 includes an image forming unit 20 to form an image on a sheet member such as a sheet P, and a sheet ejection container such as an inner tray 60 including a sheet member stacking part such as a sheet ejection tray 67 on which the sheet member ejected from an apparatus body is stacked. At least one side of the apparatus body is open and the inner tray 60 is disposed inside the apparatus. The sheet ejection tray 67 is configured to be movable between a first position in the sheet ejection container where the sheet member is ejected to the sheet member stacking part and a second position nearer to the opening than the first position.

In Aspect A, the sheet member stacking part is moved from the first position to the second position and the sheet member stacking part can approach the opening. With this structure, compared to a state in which the sheet ejection tray 67 positions at the home position in the distal end from the opening than the second position, the visibility of the sheet P on the sheet ejection tray 67 can be improved and the sheet P can be removed easily.

<Aspect B>

In Aspect A, a sheet ejection tray driver 65 to move the sheet member stacking part (that is, the sheet ejection tray 67) between the first position and the second position is disposed. With this structure, as described in the above embodiments, the sheet ejection tray driver 65 automatically moves the sheet ejection tray 67, so that the handling to move the sheet ejection tray 67 manually can be saved.

<Aspect C>

In the aspects A and B, a regulating member such as an end fence 68 is disposed on the sheet member stacking part. The end fence 68 is disposed perpendicular to the sheet member conveyance direction relative to the platen of the sheet member stacking part and is movable in the sheet conveyance perpendicular direction. The end fence 68 contacts and stops one end of the sheet in the conveyance perpendicular direction of the sheet placed on the platen, thereby preventing the sheet member from entering into the depth of the sheet ejection container.

<Aspect D>

In any one of the aspects A to C, cover members to cover at least one opening of the sheet ejection container so as to be openably closable and a switch to open or close the cover members are disposed. With this structure, when the cover member is closed in the printing operation, noise and odor can be reduced.

<Aspect E>

In the aspect D, the sheet ejection container includes at least one opening disposed downstream in the sheet ejection direction when the sheet member is ejected from an inside of the apparatus to the sheet member stacking part, and downstream in the moving direction of the sheet member stacking part moving from the first position to the second position in the direction perpendicular to the sheet member ejection direction. The cover members includes a first cover such as the left cover 62 to open or close the opening disposed downstream in the sheet ejection direction of the sheet ejection container, and a second cover such as the front cover 61 to open or close the opening disposed downstream in the moving direction of the sheet member stacking part. When the length of the sheet member in the sheet member conveyance direction is longer than the width of the sheet member stacking part in the sheet member ejection direction, the first cover is released to open. By contrast, when the length of the sheet member in the sheet member conveyance direction is shorter than the width of the sheet member stacking part in the sheet member ejection direction, the second cover is released to open. With this structure, as described in the above embodiments, the noise and odor in the printing operation is reduced, and visibility of the sheet member when using a small-sized sheet can be improved and the small-sized sheet can be removed easily, as well as the large-sized sheet can be ejected onto the sheet ejection container.

<Aspect F>

In Aspect E, the first cover and the second cover are open or closed via a driving force from a single drive source that the open/close means or the sheet ejection driver includes. With this structure, as described in the above embodiments, a low cost apparatus can be provided than a case in which a plurality of drive sources corresponding to respective covers is provided.

<Aspect G>

In any of the aspects D, E, and F, and switch 63 to open or close the cover member via the sheet ejection driver is disposed. With this structure, as described in the above embodiments, the sheet member ejected onto the sheet ejection container can be removed by the user without any concern whether the printing is being performed or not, so that a user-friendliness is improved.

<Aspect H>

In Aspect G, the switch 63 is disposed on the left-front exterior wall 101 adjacent to the front cover 61 that positions at the front of the apparatus, and an LED 63*a*, a light-emitting diode, is disposed in an interior of the switch 63. With this structure, the LED 63*a* illuminates the switch 63 to thus prompt the user to notice a state of the apparatus and to press the switch 63 down.

Furthermore, the exemplary embodiments of the present invention are not only applied to the type of image forming apparatus that includes the image forming unit and the image reading unit disposed above and below the sheet ejection portion alone. Instead, the sheet ejection tray is formed in any space inside and in the middle of the apparatus, the sheet is ejected onto the sheet ejection tray, and the ejected sheet is removed from an opening formed on a side wall of the apparatus body.

For example, the present embodiments can be applied to such a type of printer that the image forming unit is disposed at an upper part of the body of the printer, a paper tray is disposed at a bottom of the printer, and a space is formed between the image forming unit and the paper tray. The space includes at least one opening among side walls of the printer, and a sheet ejection portion having a sheet ejection tray is disposed in the above space.

Alternatively, the present embodiments can be applied to a structure in which the sheet ejection portion is not surrounded by an upper wall or a bottom wall and the sheet is ejected to the sheet ejection tray of such a sheet ejection portion. That is, the present embodiments can be applied to a printer that includes the sheet ejection portion disposed at an upper side with at least one open side and without an upper wall, and a sheet is ejected to the sheet ejection tray of such a sheet ejection portion with at least one open side and without an upper wall. Accordingly, even though a book shelf is disposed near an upper portion of the sheet ejection portion, because the sheet ejection tray can be moved to positions in the state 2 or 3 nearer to the opening than the home position in the state 1, visibility of the sheet ejected on the sheet ejection tray can be improved and the sheet can be removed without any difficulty.

The present embodiments can further be applied to a printer or a multifunction peripheral including a sheet ejection portion disposed in the bottom of the printer or apparatus, with at least one open side and without a bottom wall. For example, the sheet ejection tray is disposed between a floor or stand on which the image forming apparatus is placed and an upper wall surrounding the sheet ejection portion, and the sheet ejection tray is moved to positions in the state 2 or 3 nearer to the opening than the home position in the state 1, so that visibility of the sheet ejected on the sheet ejection tray can be improved and the sheet can be removed without any difficulty.

Additional modifications and variations of the present invention are possible in light of the above teachings. It is therefore to be understood that, within the scope of the appended claims, the invention may be practiced other than as specifically described herein.

What is claimed is:

1. An image forming apparatus, comprising:

an apparatus body including at least one side, the at least one side of the image forming apparatus is an open side;

an image forming device configured to form an image on a sheet member;

a sheet ejection container including a sheet ejection tray, a first opening and a second opening, the first opening being downstream in a sheet member ejection direction, the second opening being downstream in a moving direction of the sheet ejection tray, the first opening configured to (i) eject the sheet member from an inside of the image forming apparatus to the sheet ejection tray, the sheet ejection container being inside the apparatus body at the open side of the image forming apparatus, the sheet ejection tray configured to, stack the sheet member ejected from the apparatus body, and move between a first position and a second position in the sheet ejection container, the first position corresponding to the sheet member being ejected to the sheet ejection tray and the sheet ejection tray being opposite and away from the open side of the image forming apparatus, the second position corresponding to the sheet ejection tray being adjacent to the open side of the image forming apparatus, the moving direction of the sheet ejection tray towards the second opening corresponds to movement from the first position to the second position in a direction perpendicular to the sheet member ejection direction;

cover members including a first cover and a second cover, the cover members configured to cover at least one opening of the sheet ejection container, the first cover configured to (i) open and close the opening downstream in the sheet member ejection direction of the sheet ejection container, and (ii) open when the length of the sheet member in a sheet member conveyance direction is longer than the width of the sheet ejection tray in the sheet member ejection direction, the second cover configured to (i) open and close the opening disposed in the moving direction of the sheet ejection tray, and (ii) open when the length of the sheet member in the sheet member conveyance direction is shorter than the width of the sheet ejection tray in the sheet member ejection direction; and an assembly in the apparatus body, the assembly configured to open and close the cover members.

2. The image forming apparatus of claim 1, further including, a sheet ejection tray driver connected to the sheet ejection tray, the sheet ejection tray driver configured to move the sheet ejection tray between the first position and the second position.

3. The image forming apparatus of claim 1, further including, an end fence on the sheet ejection tray, the end face is perpendicular to the sheet member conveyance direction, the end face configured to (i) move in a sheet member conveyance perpendicular direction, and (ii) contact and stop one end of the sheet member placed on a sheet stacking surface, the sheet member conveyance perpendicular direction corresponds to conveying of the sheet member to the sheet stacking surface of the sheet ejection tray.

4. The image forming apparatus of claim 1, further including, a sheet ejection tray driver connected to the sheet ejection tray, the sheet ejection tray driver configured to open and close the first cover and the second cover.

5. The image forming apparatus of claim 4, further including, a switch in front of the apparatus body adjacent to the second cover, the switch configured to open and close the cover members via the sheet ejection tray driver.

6. The image forming apparatus of claim 5, further including, a light-emitting diode in an interior of the switch, the light-emitting diode configured to illuminate the switch.

7. The image forming apparatus of claim 1, wherein the second position of the sheet ejection tray corresponds to movement of the sheet ejection tray in a direction parallel to the sheet member ejection direction.

8. The image forming apparatus of claim 1, wherein the second position of the sheet ejection tray corresponds to movement of the sheet ejection tray in a direction perpendicular to the sheet member ejection direction.

9. An image forming apparatus, comprising:

a sheet ejection container including a first opening, a second opening and a sheet ejection tray, the sheet ejection tray configured to (i) move between a first position and a second position, and (ii) stack at least one sheet member, the first opening is downstream in a sheet member ejection direction, the second opening is downstream in a sheet member conveyance direction;

an assembly configured to open and close cover members, the cover members including a first cover and a second cover, the first cover configured to (i) open and close the first opening of the sheet ejection container, and (ii) open when length of the sheet member in the sheet member conveyance direction is longer than the width of the sheet ejection tray in the sheet member ejection direction, the second cover configured to (i) open and close the second opening of the sheet ejection container, and (ii) open when the length of the sheet member in the sheet member conveyance direction is shorter than the width of the sheet ejection tray in the sheet member ejection direction;

a sheet ejection tray driver connected to the sheet ejection tray, the sheet ejection tray driver configured to move the sheet ejection tray between the first position and the second position; and a switch in front of an apparatus body adjacent to the second cover, the switch configured to open and close the cover members via the sheet ejection tray driver.

10. The image forming apparatus of claim 9, wherein the second position of the sheet ejection tray corresponds to movement of the sheet ejection tray in a direction parallel to the sheet member ejection direction.

11. The image forming apparatus of claim 1, wherein the second position of the sheet ejection tray corresponds to movement of the sheet ejection tray in a direction perpendicular to the sheet member ejection direction.

12. A method of forming an image, comprising:

providing an image forming apparatus, the image forming apparatus includes, a sheet ejection container including a first opening, a second opening and a sheet ejection tray, the sheet ejection tray configured to (i) move between a first position and a second position and (ii) stack at least one sheet member, the first opening is downstream in a sheet member ejection direction, the second opening is downstream in a sheet member conveyance direction;

an assembly configured to open and close cover members, the cover members including a first cover and a second cover, the first cover configured to (i) open and close the first opening of the sheet ejection container, and (ii) open when length of the sheet member in the sheet member conveyance direction is longer than the width of the sheet ejection tray in the sheet member ejection direction, the second cover configured to (i) open and close the second opening of the sheet ejection container, and (ii) open when the length of the sheet member in the sheet member conveyance direction is shorter than the width of the sheet ejection tray in the sheet member ejection direction;

a sheet ejection tray driver connected to the sheet ejection tray, the sheet ejection tray driver configured to move the sheet ejection tray between the first position and the second position; and a switch in front of an apparatus body adjacent to the second cover, the switch configured to open and close the cover members via the sheet ejection tray driver.

13. The method of claim 12, wherein the second position of the sheet ejection tray corresponds to movement of the sheet ejection tray in a direction parallel to the sheet member ejection direction.

14. The method of claim 12, wherein the second position of the sheet ejection tray corresponds to movement of the sheet ejection tray in a direction perpendicular to the sheet member ejection direction.

* * * * *